US010636399B2

(12) United States Patent
Maezawa

(10) Patent No.: US 10,636,399 B2
(45) Date of Patent: Apr. 28, 2020

(54) CONTROL METHOD AND CONTROL DEVICE

(71) Applicant: Yamaha Corporation, Hamamatsu, Shizuoka (JP)

(72) Inventor: Akira Maezawa, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 16/252,293

(22) Filed: Jan. 18, 2019

(65) Prior Publication Data

US 2019/0172433 A1 Jun. 6, 2019

Related U.S. Application Data

(63) Continuation of application No. PCT/JP2017/026526, filed on Jul. 21, 2017.

(30) Foreign Application Priority Data

Jul. 22, 2016 (JP) ..... 2016-144350

(51) Int. Cl.
*G10H 1/00* (2006.01)
*G10H 1/40* (2006.01)
(Continued)

(52) U.S. Cl.
CPC ..... *G10H 1/0008* (2013.01); *G10G 1/00* (2013.01); *G10G 3/04* (2013.01); *G10H 1/00* (2013.01);
(Continued)

(58) Field of Classification Search
CPC ..... G06K 15/1807; G06K 15/4015; G06K 15/1836; G06F 3/1203; G06F 3/1268; G06F 3/1255; H04N 1/00411; H04N 2201/0094; G10H 1/0008; G10H 1/00; G10H 1/361; G10H 1/40; G10H 2240/325; G10H 2210/391; G10H 2250/015;
(Continued)

(56) References Cited

U.S. PATENT DOCUMENTS 4,341,140 A * 7/1982 Ishida ..... G10H 1/26 84/711
5,177,311 A * 1/1993 Suzuki ..... G10H 1/00 84/600
(Continued)

FOREIGN PATENT DOCUMENTS

JP H05-27752 A 2/1993
JP 2007-241181 A 9/2007
(Continued)

OTHER PUBLICATIONS

International Search Report in PCT/JP2017/026526 dated Oct. 17, 2017.

*Primary Examiner* — Jeffrey Donels
(74) *Attorney, Agent, or Firm* — Global IP Counselors, LLP

(57) ABSTRACT

A control method includes receiving a detection result relating to a first event in a performance; changing a following degree in a middle of the performance to which a second event in the performance follows the first event; and determining an operating mode of the second event based on the following degree.

6 Claims, 4 Drawing Sheets

(51) Int. Cl.
*G10G 1/00* (2006.01)
*G10H 1/36* (2006.01)
*G10G 3/04* (2006.01)

(52) U.S. Cl.
CPC ..... *G10H 1/361* (2013.01); *G10H 1/40* (2013.01); *G10H 2210/061* (2013.01); *G10H 2210/066* (2013.01); *G10H 2210/071* (2013.01); *G10H 2210/391* (2013.01); *G10H 2240/325* (2013.01); *G10H 2250/015* (2013.01)

(58) Field of Classification Search
CPC ..... G10H 2210/071; G10H 2210/066; G10H 2210/061; G10G 3/04; G10G 1/00
USPC ..... 84/600, 609, 649
See application file for complete search history.

(56) References Cited

U.S. PATENT DOCUMENTS 5,288,938 A * 2/1994 Wheaton ..... G06K 9/00335 84/600
5,648,627 A * 7/1997 Usa ..... G10H 1/0556 84/600
5,663,514 A * 9/1997 Usa ..... G10H 1/40 84/600
5,913,259 A * 6/1999 Grubb ..... G10H 1/36 84/610
5,952,597 A * 9/1999 Weinstock ..... G10G 3/04 84/477 R
6,166,314 A * 12/2000 Weinstock ..... G10G 3/04 84/477 R
6,919,503 B2 * 7/2005 Nishitani ..... G10H 1/0058 84/633
8,445,771 B2 * 5/2013 Sakazaki ..... G10H 1/0008 84/626
8,586,853 B2 * 11/2013 Sakazaki ..... G10H 1/053 84/725
8,660,678 B1 * 2/2014 Lavi ..... G10H 1/0066 700/94
9,171,531 B2 * 10/2015 David ..... G10H 1/40
10,418,012 B2 * 9/2019 Katz ..... G10H 1/42
2002/0170413 A1 * 11/2002 Nishitani ..... G10H 1/0066 84/600
2007/0234882 A1 * 10/2007 Usa ..... G10H 1/0008 84/612
2010/0017034 A1 * 1/2010 Nakadai ..... A63H 3/28 700/258
2011/0214554 A1 * 9/2011 Nakadai ..... G09B 15/02 84/477 R
2015/0143976 A1 * 5/2015 Katto ..... A63F 13/211 84/602
2019/0012997 A1 * 1/2019 Katz ..... G10H 1/045
2019/0147837 A1 * 5/2019 Maezawa ..... G10G 3/04
2019/0156801 A1 * 5/2019 Maezawa ..... G10H 5/007
2019/0156802 A1 * 5/2019 Maezawa ..... G10H 1/0025
2019/0156809 A1 * 5/2019 Maezawa ..... G10H 1/00

FOREIGN PATENT DOCUMENTS

JP 2011-180590 A 9/2011
JP 2015-79183 A 4/2015

* cited by examiner

CONTROL METHOD AND CONTROL DEVICE

CROSS-REFERENCE TO RELATED APPLICATIONS

This application is a continuation application of International Application No. PCT/JP2017/026526, filed on Jul. 21, 2017, which claims priority to Japanese Patent Application No. 2016-144350 filed in Japan on Jul. 22, 2016. The entire disclosures of International Application No. PCT/JP2017/026526 and Japanese Patent Application No. 2016-144350 are hereby incorporated herein by reference.

BACKGROUND

Technological Field

The present invention relates to a control method and a control device.

Background Information

A technology for estimating a position of a performer's performance on a musical score based on a sound signal that indicates an emission of sound by the performer is known (for example, refer to Japanese Laid-Open Patent Application No. 2015-79183).

In an ensemble system in which a performer and an automatic performance instrument, and the like, play together, for example, a process is carried out for predicting a timing of an event in which the automatic performance instrument emits a next sound, based on an estimation result of a position of the performer's performance on a musical score. However, in such an ensemble system, the degree of synchronization between the performer's performance and the performance of the automatic performance instrument could not be changed in the middle of the performance.

SUMMARY

The present disclosure was made in light of the circumstance described above, and one solution thereto is to provide a technology for changing the degree of synchronization between the performer's performance and the performance of the automatic performance instrument in the middle of the performance.

A control method according to an aspect of this disclosure comprises receiving a detection result relating to a first event in a performance; changing a following degree in a middle of the performance to which a second event in the performance follows the first event; and determining an operating mode of the second event based on the following degree.

In addition, a control device according to an aspect of this disclosure comprises an electronic controller including at least one processor, and the electronic controller is configured to execute a plurality of modules including a reception unit that receives a detection result related to a first event in a performance, a changing unit that changes a following degree in a middle of the performance to which a second event in the performance follows the first event, and an operation determination unit that determines an operating mode of the second event based on the following degree.

DETAILED DESCRIPTION OF THE EMBODIMENTS

Selected embodiments will now be explained with reference to the drawings. It will be apparent to those skilled in the field of musical performances from this disclosure that the following descriptions of the embodiments are provided for illustration only and not for the purpose of limiting the invention as defined by the appended claims and their equivalents.

1. Configuration

Figure 1:
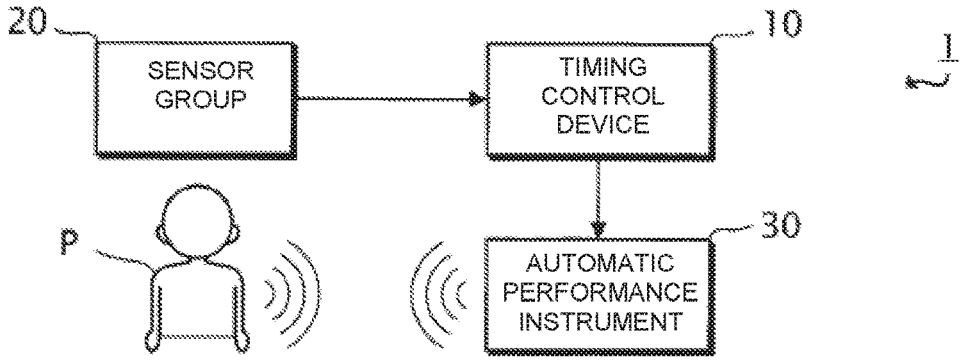
FIG. 1 is a block diagram showing one example of a configuration of an ensemble system 1 according to an embodiment.

FIG. 1 is a block diagram showing a configuration of an ensemble system 1 according to the present embodiment. The ensemble system 1 is used for a human performer P and an automatic performance instrument 30 to realize an ensemble. That is, in the ensemble system 1, the automatic performance instrument 30 carries out a performance in accordance with the performance of the performer P. The ensemble system 1 comprises a timing control device (control device) 10, a sensor group 20, and the automatic performance instrument 30. In the present embodiment, a case in which a musical piece that is played together by the performer P and the automatic performance instrument 30 will be assumed. That is, the timing control device 10 stores music data which represent a musical score of the musical piece that is played together by the performer P and the automatic performance instrument 30.

The performer P plays a musical instrument. The sensor group 20 detects information related to the performance by the performer P. In the present embodiment, the sensor group 20 includes, for example, a microphone that is placed in front of the performer P. The microphone collects the sounds of the performance sound that is emitted from the instrument that is played by the performer P, converts the collected performance sound into a sound signal and outputs the sound signal.

The timing control device 10 controls the timing with which the automatic performance instrument 30 follows the performance of the performer P. The timing control device 10 carries out three processes based on the sound signal that is supplied from the sensor group 20: (1) estimating the position of the performance on the musical score (can be referred to as "estimating the performance position"), (2) predicting the time (timing) at which a next sound should be emitted in the performance by the automatic performance instrument 30 (can be referred to as "predicting the sound generation time"), and (3) outputting a performance command with respect to the automatic performance instrument 30 (can be referred to as "outputting the performance command"). Here, estimating the performance position is a process for estimating the position in the musical score of the ensemble by the performer P and the automatic performance instrument 30. Predicting the sound generation time is a process for predicting the time at which the next sound generation should be carried out by the automatic performance instrument 30 using an estimation result of the performance position. Outputting the performance command is a process for outputting the performance command with respect to the automatic performance instrument 30 in accordance with the predicted sound generation time. The sound generated by the performer P during the performance is one example of the "first event" and the sound generated by the automatic performance instrument 30 during the performance is one example of the "second event". Hereinbelow, the first event and the second event can be referred to collectively as "events."

The automatic performance instrument 30 is capable of carrying out a performance in accordance with the performance command that is supplied by the timing control device 10, irrespective of human operation, one example being an automatic playing piano.

Figure 2:
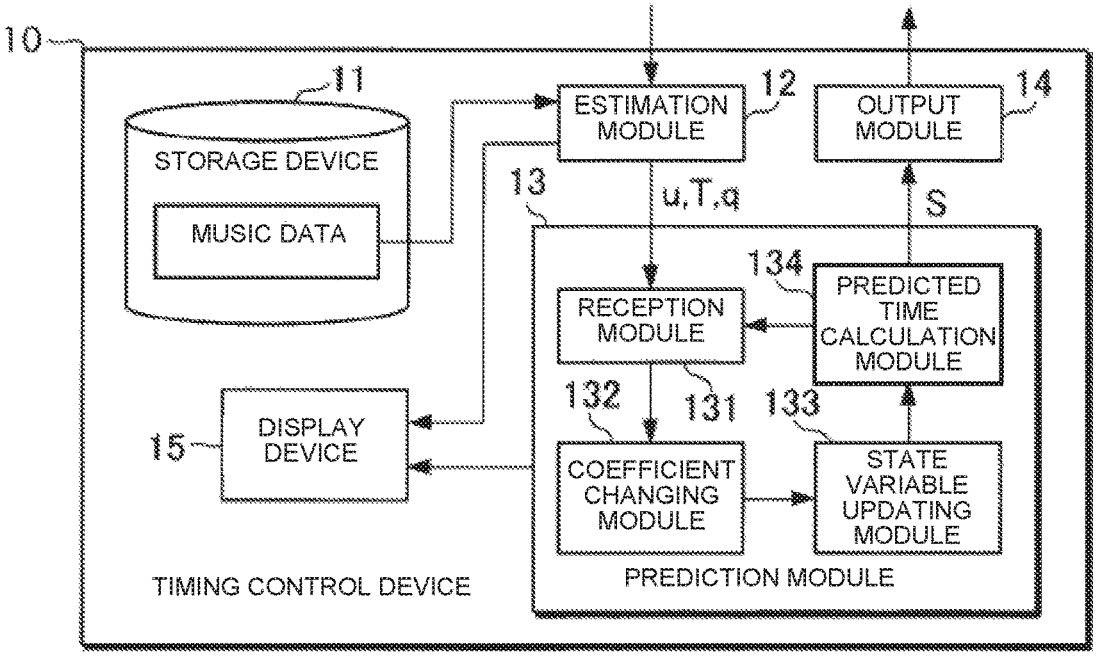
FIG. 2 is a block diagram illustrating a functional configuration of a timing control device.

FIG. 2 is a block diagram illustrating a functional configuration of the timing control device 10. The timing control device 10 comprises a storage device 11, an estimation module 12, a prediction module 13, an output module 14, and a display device 15.

The storage device 11 stores various data. In this example, the storage device 11 stores music data. The music data include at least timing and pitch of the generated sounds that are designated by a musical score. The timing of generated sounds indicated by the music data is, for example, expressed based on time units (for example, thirty-second notes) set on the musical score. In addition to the timing and pitch of the generated sounds that are designated by the musical score, the musical data can also include information that indicates at least one or more of sound duration, tone, or sound volume each of which is designated by the musical score. For example, the music data are in the MIDI (Musical Instrument Digital Interface) format.

The estimation module 12 analyzes the input sound signal and estimates the performance position in the musical score. The estimation module 12 first extracts information relating to the pitch and an onset time (sound generation starting time) from the sound signal. Next, the estimation module 12 calculates, from the extracted information, a stochastic estimated value which indicates the performance position in the musical score. The estimation module 12 outputs the estimated value obtained by means of the calculation.

In the present embodiment, the estimated value that is output by the estimation module 12 includes a sound generation position u, observation noise q, and a sound generation time T. The sound generation position u is the position in the musical score (for example, the second beat of the fifth measure) of a sound that is generated during the performance by the performer P or the automatic performance instrument 30. The observation noise q is the observation noise (stochastic variation) of the sound generation position u. The sound generation position u and the observation noise q are expressed, for example, based on the time units that are set on the musical score. The sound generation time T is the time (position on a time axis) at which sound generated by the performer P during the performance is observed. In the description below, the sound generation position that corresponds to the nth music note that is generated during the performance of the musical piece is expressed as u[n] (where n is a natural number such that n≥1). The same applies to the other estimated values.

The prediction module 13 predicts the time (predicts the sound generation time) at which the next sound generation should be carried out in the performance by the automatic performance instrument 30 by means of using the estimated value that is supplied from the estimation module 12 as an observation value. In the present embodiment, a case in which the prediction module 13 predicts the sound generation time using a so-called Kalman filter will be assumed as an example.

Hereinbelow, the prediction of the sound generation time according to the related technology will be described before the prediction of the sound generation time according to the present embodiment is described. Specifically, the prediction of the sound generation time using a regression model and the prediction of the sound generation time using a dynamic model will be described as the prediction of the sound generation time according to the related technology.

First, with regard to the prediction of the sound generation time according to the related technology, the prediction of the sound generation time using the regression model will be described.

The regression model estimates the next sound generation time using the history of the times that sounds were generated by the performer P and the automatic performance instrument 30. The regression model can be expressed by the following equation (1), for example.

Equation $$S[n+1] = G_n \begin{pmatrix} S[n] \\ S[n-1] \\ \vdots \\ S[n-j] \end{pmatrix} + H_n \begin{pmatrix} u[n] \\ u[n-1] \\ \vdots \\ u[n-j] \end{pmatrix} + \alpha_n \tag{1}$$

Here, the sound generation time S[n] is the sound generation time of the automatic performance instrument 30. The sound generation position u[n] is the sound generation position of the performer P. In the regression model shown in equation (1), a case is assumed in which the sound generation time is predicted using "j+1" observation values (where j is a natural number such that 1≤j<n). In the description relating to the regression model shown in equation (1), a case is assumed in which the sound performed by the performer P can be distinguished from the performance sound of the automatic performance instrument 30. The matrix $G_n$ and the matrix $H_n$ are matrices corresponding to regression coefficients. The subscripts n of the matrix $G_n$, the matrix $H_n$, and the coefficient αn indicate that the matrix $G_n$, the matrix $H_n$, and the coefficient $\alpha_n$ are elements that correspond to the nth musical note played. That is, when using the regression model shown in equation (1), the matrix $G_n$, the matrix $H_n$, and the coefficient $\alpha_n$ can be set in one-to-one correspondence with a plurality of musical notes that are included in the musical score of the musical piece. In other words, it is possible to set the matrix $G_n$, the matrix $H_n$, and the coefficient $\alpha_n$ in accordance with the position in the musical score. As a result, according to the regression model shown in equation (1), it becomes possible to predict the sound generation time S in accordance with the position in the musical score.

Next, with regard to the prediction of the sound generation time according to the related technology, the prediction of the sound generation time using the dynamic model will be described.

In general, in the dynamic model, a state vector V that represents a state of a dynamic system to be a target of prediction by the dynamic model is updated by means of the following process, for example.

Specifically, first, the dynamic model predicts the state vector V after a change from the state vector V before the change, using a state transition model, which is a theoretical model that represents temporal changes in the dynamic system. Second, the dynamic model predicts the observation value from a predicted value of the state vector V according to the state transition model, using an observation model, which is a theoretical model that represents the relationship between the state vector V and the observation value. Third, the dynamic model calculates an observation residual based on the observation value predicted by the observation model and the observation value that is actually supplied from outside of the dynamic model. Fourth, the dynamic model calculates an updated state vector V by correcting the predicted value of the state vector V according to the state transition model by using the observation residual. The dynamic model updates the state vector V in this manner.

In the present embodiment, a case is assumed in which the state vector V includes a performance position x and a velocity v as elements, for example. Here, the performance position x is a state variable that represents the estimated value of the performance position of the performer P or the automatic performance instrument 30 on the musical score. In addition, the velocity v is a state variable that represents the estimated value of the velocity (tempo) of the performance by the performer P or the automatic performance instrument 30 on the musical score. However, the state vector V can include other state variables besides the performance position x and the velocity v.

In the present embodiment, a case is assumed in which the state transition model is represented by the following equation (2), and the observation model is represented by the following equation (3), for example.

Equation $$V[n]=A_n V[n-1]+e[n] \tag{2}$$

Equation $$u[n]=O_n V[n]+q[n] \tag{3}$$

Here, the state vector V[n] is a k-dimensional vector (where k is a natural number such that k≥2), having, as elements, a plurality of state variables including the performance position x[n] and the velocity v[n], which correspond to the nth musical note played. The process noise e[n] is a k-dimensional vector that represents noise which accompanies a state transition that uses the state transition model. The matrix $A_n$ represents the coefficient that relates to the updating of the state vector V in the state transition model. The matrix $O_n$ represents the relationship between the observation value (in this example, the sound generation position u) and the state vector V in the observation model. The subscript n appended to each type of element, such as the matrices and the variables, indicates that said element corresponds to the nth musical note.

Equations (2) and (3) can be embodied, for example, as the following equation (4) and equation (5).

Equation $$\begin{pmatrix} x[n] \\ v[n] \end{pmatrix} = \begin{pmatrix} 1 & T[n]-T[n-1] \\ 0 & 1 \end{pmatrix} \begin{pmatrix} x[n-1] \\ v[n-1] \end{pmatrix} + e[n] \tag{4}$$

-continued

Equation $$u[n] = x[n] + q[n] \tag{5}$$

If the performance position x[n] and the velocity v[n] can be obtained from equations (4) and (5), it is possible to obtain the performance position x[t] at a future time t from the following equation (6).

Equation $$x[t]=x[n]+v[n](t-T[n]) \tag{6}$$

By applying the calculation result according to equation (6) to the following equation (7), it is possible to calculate the sound generation time S[n+1] at which the automatic performance instrument 30 should sound the (n+1)th musical note.

Equation $$S[n+1] = T[n] + \frac{x[n+1]-x[n]}{v[n]} \tag{7}$$

The dynamic model has the advantage that it is possible to predict the sound generation time S corresponding to the position in the musical score. In addition, the dynamic model has the advantage that, in principle, parameter tuning (learning) in advance is not necessary.

In the ensemble system 1, there are cases in which there is a desire to adjust the degree of synchronization between the performance of the performer P and the performance of the automatic performance instrument 30. In other words, in the ensemble system 1, there are cases in which there is a desire to adjust the degree to which the performance of the automatic performance instrument 30 follows the performance of the performer P.

However, in the regression model according to the related technology, in order to respond to said desires, for example, when the degree of synchronization between the performance of the performer P and the performance of the automatic performance instrument 30 is variously changed, it becomes necessary to conduct preliminary learning regarding each of various degrees of synchronization that could be changed. In this case, there is the problem that the processing load increases during preliminary learning.

In addition, in order to respond to said desires with regard to the dynamic model according to the related technology, for example, the degree of synchronization is adjusted accordion to the process noise e[n], or the like. However, even in this case, the sound generation time S[n+1] is calculated based on the observation value according to the sound generated by the performer P, such as the sound generation time T[n], or the like; therefore, there are cases in which the degree of synchronization cannot be flexibly adjusted.

In contrast, the prediction module 13 according to the present embodiment predicts the sound generation time S[n+1] by means of a mode that is capable of more flexibly adjusting the degree to which the performance of the automatic performance instrument 30 follows the performance of the performer P compared with the related technology, while being based on the dynamic model according to the related technology. One example of the process of the prediction module 13 according to the present embodiment will be described below.

The prediction module 13 according to the present embodiment updates the state vector that represents the state of the dynamic system related to the performance of the performer P (referred to as "state vector Vu") and the state vector that represents the state of the dynamic system related to the performance of the automatic performance instrument 30 (referred to as "state vector Va"). Here, the elements of the state vector Vu include the performance position xu, which is the state variable that represents an estimated position of the performance of the performer P on the musical score, and the velocity vu, which is the state variable that represents the estimated value of the velocity of the performance of the performer P on the musical score. Here, the elements of the state vector Va include the performance position xa, which is the state variable that represents an estimated value of the position of the performance by the automatic performance instrument 30 on the musical score, and the velocity va, which is the state variable that represents the estimated value of the velocity of the performance by the automatic performance instrument 30 on the musical score. Hereinbelow, the state variables included in the state vector Vu (performance position xu and velocity vu) are referred to collectively as the "first state variables," and the state variables included in the state vector Va (performance position xa and velocity va) are referred to collectively as the "second state variables."

As an example, the prediction module 13 according to the present embodiment updates the first state variables and the second state variables using the state transition model shown in the following equations (8) to (11). Of the foregoing, the first state variables are updated in the state transition model by means of the following equations (8) and (11). These equations (8) and (11) embody equation (4). In addition, the second state variables are updated in the state transition model by means of the following equations (9) and (10) instead of the equation (4) described above.

Equation $$xu[n]=xu[n-1]+(T[n]-T[n-1])vu[n-1]+exu[n] \tag{8}$$

Equation $$xa[n]=\gamma[n]\{xa[n-1]+(T[n]-T[n-1])va[n-1]+exa[n]\}+(1-\gamma[n])\{xu[n-1]+(T[n]-T[n-1])vu[n-1]+exu[n]\} \tag{9}$$

Equation $$va[n]=va[n-1]+eva[n] \tag{10}$$

Equation $$vu[n]=vu[n-1]+evu[n] \tag{11}$$

Here, the process noise exu[n] occurs when the performance position xu[n] is updated according to the state transition model, the process noise exa[n] occurs when the performance position xa[n] is updated according to the state transition model, the process noise eva[n] occurs when the velocity va[n] is updated according to the state transition model, and the process noise evu[n] occurs when the velocity vu[n] is updated according to the state transition model. In addition, a coupling coefficient γ[n] is a real number such that $0 \leq \gamma[n] \leq 1$. In equation (9), the value "1−γ[n]" that is multiplied by the performance position xu, which is a first state variable, is one example of a "following coefficient."

As shown in equations (8) and (11), the prediction module 13 according to the present embodiment predicts the performance position xu[n] and the velocity vu[n], which are the first state variables, using the performance position xu[n−1] and the velocity vu[n−1], which are the first state variables. On the other hand, as shown in equations (9) and (10), the prediction module 13 according to the present embodiment predicts the performance position xa[n] and the velocity va[n], which are the second state variables, using the performance position xu[n−1] and the velocity vu[n−1], which are the first state variables, and/or the performance position xa[n−1] and the velocity va[n−1], which are the second state variables.

In addition, the prediction module 13 according to the present embodiment uses the state transition model shown in equations (8) and (11) and the observation model shown in equation (5), when updating the performance position xu[n] and the velocity vu[n], which are the first state variables. On the other hand, the prediction module 13 according to the present embodiment uses the state transition model shown in equations (9) and (10) but does not use the observation model, when updating the performance position xa[n] and the velocity va[n], which are the second state variables.

As shown in equation (9), the prediction module 13 according to the present embodiment predicts the performance position xa[n], which is a second state variable, based on the value obtained by multiplying the following coefficient (1−γ[n]) by a first state variable (for example, the performance position xu[n−1]), and the value obtained by multiplying the coupling coefficient γ[n] by a second state variable (for example, the performance position xa[n−1]). Accordingly, the prediction module 13 according to the present embodiment can adjust the degree to which the performance by the automatic performance instrument 30 follows the performance of the performer P by means of adjusting the value of the coupling coefficient γ[n]. In other words, the prediction module 13 according to the present embodiment can adjust the degree of synchronization between the performance of the performer P and the performance of the automatic performance instrument 30 by means of adjusting the value of the coupling coefficient γ[n]. If the following coefficient (1−γ[n]) is set to a large value, it is possible to increase the ability of the performance by the automatic performance instrument 30 to follow the performance by the performer P, compared to when a small value is set. In other words, if the coupling coefficient γ[n] is set to a large value, it is possible to reduce the ability of the performance by the automatic performance instrument 30 to follow the performance by the performer P, compared to when a small value is set.

As described above, according to the present embodiment, it is possible to adjust the degree of synchronization between the performance of the performer P and the performance of the automatic performance instrument 30 by means of changing the value of a single coefficient, the coupling coefficient γ (an example of "following degree"). In other words, according to the present embodiment, it is possible to adjust the mode of the sound generation by the automatic performance instrument 30 during the performance (an example of "operating mode of the second event"), based on the following coefficient (1−γ[n]).

The prediction module 13 includes a reception module 131, a coefficient changing module (changing module) 132, a state variable updating module (operation determination module) 133, and a predicted time calculation module 134.

The reception module 131 receives a detection result relating to the first event in the performance. More specifically, the reception module 131 receives an input of the observation value relating to the timing of the performance. In the present embodiment, the observation value relating to the timing of the performance includes a first observation value that relates to the performance timing by the performer P. However, in addition to the first observation value, the observation value relating to the timing of the performance can include a second observation value that relates to the performance timing by the automatic performance instrument 30. Here, the first observation value is a collective term for the sound generation position u that relates to the performance of the performer P (hereinafter referred to as "sound generation position uu") and the sound generation time T. In addition, the second observation value is a collective term for the sound generation position u that relates to the performance of the automatic performance instrument 30 (hereinafter referred to as "sound generation position ua") and the sound generation time S. In addition to the observation value relating to the timing of the performance, the reception module 131 receives an input of an observation value accompanying the observation value relating to the timing of the performance. In the present embodiment, the accompanying observation value is the observation noise q that relates to the performance of the performer P. The reception module 131 stores the received observation values in the storage device 11.

The coefficient changing module 132 changes, in the middle of the performance, a following degree to which the second event in the performance follows the first event. The coefficient changing module 132 can change the value of the coupling coefficient γ in the middle of the performance of the musical piece. The value of the coupling coefficient γ is set in advance in accordance with, for example, the performance position in the musical score (musical piece).

The storage device 11 according to the present embodiment stores profile information, in which, for example, the performance position in the musical score and the value of the coupling coefficient γ corresponding to the performance position are associated with each other. Then, the coefficient changing module 132 refers to the profile information that is stored in the storage device 11 and acquires the value of the coupling coefficient γ that corresponds to the performance position in the musical score. Then, the coefficient changing module 132 sets the value acquired from the profile information as the value of the coupling coefficient γ.

The coefficient changing module 132 can set the value of the coupling coefficient γ to a value corresponding, for example, to an instruction from an operator of the timing control device 10 (one example of a "user"). In this case, the timing control device 10 has a UI (User Interface) for receiving an operation that indicates the instruction from the operator. This UI can be a software UI (UI via a screen displayed by software) or a hardware UI (fader, etc.). In general, the operator is different from the performer P, but the performer P can be the operator.

As described above, the coefficient changing module 132 according to the present embodiment sets the value of the coupling coefficient γ to a value corresponding to the performance position in the musical piece. That is, the coefficient changing module 132 according to the present embodiment can change the value of the coupling coefficient γ in the middle of the musical piece. As a result, in the present embodiment, it is possible to change the degree to which the performance of the automatic performance instrument 30 follows the performance of the performer P in the middle of the musical piece, to impart a human-like quality to the performance by the automatic performance instrument 30.

The state variable updating module 133 determines an operating mode of the second event based on the following degree. The state variable updating module 133 updates the state variables (the first state variables and the second state variables). Specifically, the state variable updating module 133 according to the present embodiment updates the state variables using the above-described equation (5) and equations (8) to (11). More specifically, the state variable updating module 133 according to the present embodiment updates the first state variables using the equations (5), (8), and (11), and updates the second state variables using the equations (9) and (10). Then, the state variable updating module 133 outputs the updated state variables.

As is clear from the description above, the state variable updating module 133 updates the second state variables based on the coupling coefficient γ that has the value determined by the coefficient changing module 132. In other words, the state variable updating module 133 updates the second state variables based on the following coefficient (1−γ[n]). Accordingly, the timing control device 10 according to the present embodiment adjusts the mode of the sound generation by the automatic performance instrument 30 during the performance based on the following coefficient (1−γ[n]).

The predicted time calculation module 134 calculates the sound generation time S[n+1], which is the time of the next sound generation by the automatic performance instrument 30, using the updated state variables.

Specifically, first, the predicted time calculation module 134 applies the state variables updated by the state variable updating module 133 to the equation (6) to calculate the performance position x[t] at a future time t. More specifically, the predicted time calculation module 134 applies the performance position xa[n] and the velocity va[n] updated by the state variable updating module 133 to the equation (6) to calculate the performance position x[n+1] at the future time t. Next, the predicted time calculation module 134 uses equation (7) to calculate the sound generation time S[n+1] at which the automatic performance instrument 30 should sound the (n+1)th musical note.

The output module 14 outputs the performance command corresponding to the musical note that the automatic performance instrument 30 should sound next to the automatic performance instrument 30, in accordance with the sound generation time S[n+1] that is input from the prediction module 13. The timing control device 10 has an internal clock (not shown) and measures the time. The performance command is described according to a designated data format. The designated data format is, for example, MIDI. The performance command includes, for example, a note-on message, a note number, and velocity.

The display device 15 displays information relating to the estimation result of the performance position and information relating to a prediction result of the next sound generation time by the automatic performance instrument 30. The information relating to the estimation result of the performance position includes, for example, at least one or more of the musical score, a frequency spectrogram of the sound signal that is input, or a probability distribution of the estimated value of the performance position. The information relating to the prediction result of the next sound generation time includes, for example, the state variable. By means of the display of information relating to the estimation result of the performance position and the information relating to the prediction result of the next sound generation time by the display device 15, it is possible for the operator (user) of the timing control device 10 to ascertain the operating state of the ensemble system 1.

Figure 3:
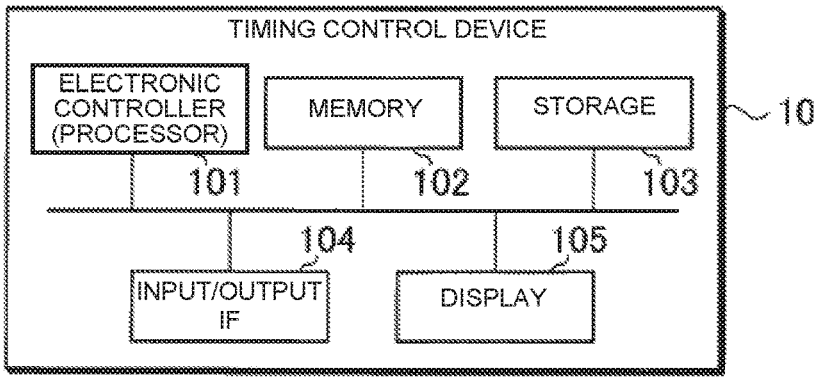
FIG. 3 is a block diagram illustrating a hardware configuration of the timing control device.

FIG. 3 is a block diagram illustrating the hardware configuration of the timing control device 10. The timing control device 10 is a computer device comprising an electronic controller (processor) 101, a memory 102, a storage 103, an input/output IF 104, and a display 105.

The electronic controller 101 is, for example, a CPU (Central Processing Unit), which controls each module and device of the timing control device 10. The electronic controller 101 includes at least one processor. The term "electronic controller" as used herein refers to hardware that executes software programs. The electronic controller 101 can be configured to comprise, instead of the CPU or in addition to the CPU, programmable logic devices such as a DSP (Digital Signal Processor), an FPGA (Field Programmable Gate Array), etc. In addition, the electronic controller 101 can include a plurality of CPUs (or a plurality of programmable logic devices). The memory 102 is a non-transitory storage medium, and is, for example, a nonvolatile memory such as a RAM (Random Access Memory). The memory 102 functions as a work area when the processor 101 of the electronic controller executes a control program, which is described further below. The storage 103 is a non-transitory storage medium and is, for example, a nonvolatile memory such as an EEPROM (Electrically Erasable Programmable Read-Only Memory). The storage 103 stores various programs, such as a control program, for controlling the timing control device 10, as well as various data. The input/output IF 104 is an interface for inputting signals from or outputting signals to other devices. The input/output IF 104 includes, for example, a microphone input and a MIDI output. The display 105 is a device for outputting various information, and includes, for example, an LCD (Liquid Crystal Display).

The processor of the electronic controller 101 executes the control program that is stored in the storage 103 and operates according to the control program to thereby function as the estimation module 12, the prediction module 13, and the output module 14. One or both of the memory 102 and the storage 103 can function as the storage device 11. The display 105 can function as the display device 15.

2. Operation

Figure 4:
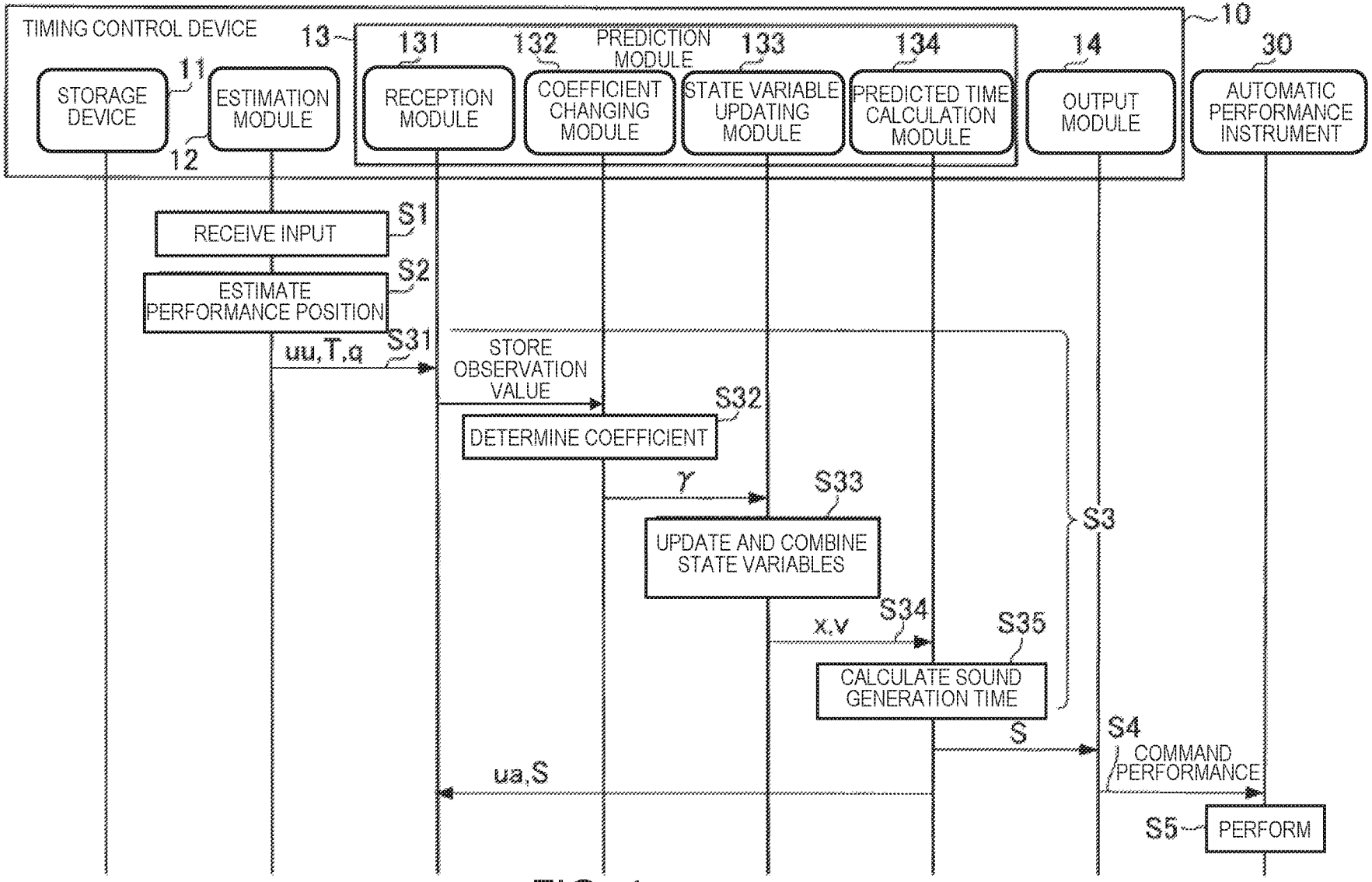
FIG. 4 is a sequence chart illustrating an operation of the timing control device 10.

FIG. 4 is a sequence chart illustrating an operation of the timing control device 10. The sequence chart of FIG. 4 starts, for example, with the triggering by the processor of the electronic controller 101 activating the control program.

In Step S1, the estimation module 12 receives the input of the sound signal. When the sound signal is an analog signal, for example, the sound signal is converted into a digital signal by a D/A converter (not shown) that is provided in the timing control device 10, and the sound signal that has been converted into a digital signal is input to the estimation module 12.

In Step S2, the estimation module 12 analyzes the sound signal and estimates the performance position in the musical score. The process relating to Step S2 is carried out, for example, in the following manner. In the present embodiment, the transition of the performance position in the musical score (musical score time series) is described using a probability model. By using a probability model to describe the musical score time series, it is possible to deal with such problems as mistakes in the performance, omission of repeats in the performance, fluctuation in the tempo of the performance, and uncertainty in the pitch or the sound generation time in the performance, An example of the probability model that describes the musical score time series that can be used is the hidden Semi Markov model (Hidden Semi-Markov Model, HSMM). The estimation module 12 obtains the frequency spectrogram, for example, by dividing the sound signal into frames and applying a constant-Q transform. The estimation module 12 extracts the onset time and the pitch from the frequency spectrogram. For example, the estimation module 12 sequentially estimates the distribution of the stochastic estimated values which indicate the performance position in the musical score by means of Delayed-decision, and outputs a Laplace approximation of the distribution and one or more statistical quantities at the point in time at which the peak of the distribution passes the position that is considered the beginning of the musical score. Specifically, when the sound generation that corresponds to the nth musical note that exists in the music data is detected, the estimation module 12 outputs the sound generation time T[n] at which the sound generation is detected, and the average position in the musical score in the distribution that indicates the stochastic position of the sound generation in the musical score, and the variance. The average position in the musical score is the estimated value of the sound generation position u[n], and the variance is the estimated value of the observation noise q[n]. Details of the estimation of the sound generation position is disclosed in, for example, Japanese Laid-Open Patent Application No. 2015-79183.

Figure 5:
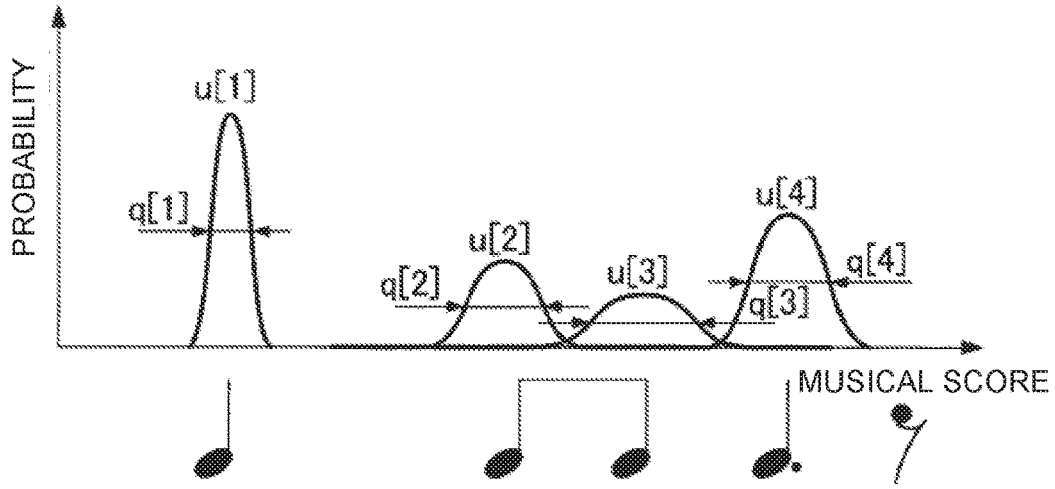
FIG. 5 is an explanatory view for explaining a sound generation position u[n] and observation noise q[n].

FIG. 5 is an explanatory view for explaining the sound generation position u[n] and the observation noise q[n]. In the example shown in FIG. 5, a case in which four musical notes are included in one bar of the musical score is illustrated. The estimation module 12 calculates the probability distributions P[1]-P[4], which correspond one-to-one with four generated sounds corresponding to four musical notes included in the one bar. Then, the estimation module 12 outputs the sound generation time T[n], the sound generation position u[n], and the observation noise q[n] based on the calculation result.

FIG. 4 is referred to again. In Step S3, the prediction module 13 predicts the next sound generation time by the automatic performance instrument 30 using the estimated value that is supplied from the estimation module 12 as the observation value. One example of the details of the process in Step S3 will be described below.

In Step S3, the reception nodule 131 receives input of the observation values (first observation values) such as the sound generation position uu, the sound generation time T, and the observation noise q, supplied from the estimation module 12 (Step S31). The reception module 131 stores these observation values in the storage device 11.

In Step S3, the coefficient changing module 132 determines the value of the coupling coefficient γ that is used to update the state variable (Step S32). Specifically, the coefficient changing module 132 references the profile information that is stored in the storage device 11, acquires the value of the coupling coefficient γ that corresponds to the current performance position in the musical score, and sets the acquired value to the coupling coefficient γ. As a result, it becomes possible to adjust the degree of synchronization between the performance of the performer P and the performance of the automatic performance instrument 30 in accordance with the performance position in the musical score. That is, the timing control device 10 according to the present embodiment is capable of causing the automatic performance instrument 30 to execute an automatic performance that follows the performance of the performer P in certain portions of the musical piece, and to execute an independent automatic performance independently of the performance of the performer P in other portions of the musical piece. Accordingly, the timing control device 10 according to the present embodiment is able to impart a human-like quality to the performance of the automatic performance instrument 30. For example, when the tempo of the performance of the performer P is clear, the timing control device 10 according to the present embodiment can cause the automatic performance instrument 30 to execute the automatic performance at a tempo at which the ability of the performer P to follow the tempo of the performance is greater than the ability to follow the tempo of the performance that has been set in advance by the music data. Additionally, for example, when the tempo of the performance of the performer P is not clear, the timing control device 10 according to the present embodiment can cause the automatic performance instrument 30 to execute the automatic performance at a tempo at which the ability to follow the tempo of the performance that has been set in advance by the music data is greater than the ability of the performer P to follow the tempo of the performance.

In Step S3, the state variable updating module 133 updates the state variables using the input observation value (Step S33). As described above, in Step S33, the state variable updating module 133 updates the first state variables using equations (5), (8), and (11), and updates the second state variables using equations (9) and (10). In addition, in Step S33, the state variable updating module 133 updates the second state variables based on the following coefficient $(1-\gamma[n])$, as shown in equation (9).

In Step S3, the state variable updating module 133 outputs the state variables updated in Step S33 to the predicted time calculation module 134 (Step S34). Specifically, the state variable updating module 133 according to the present embodiment outputs the performance position xa[n] and the velocity va[n] updated in Step S33 to the predicted time calculation module 134.

In Step S3, the predicted time calculation module 134 applies the state variables that are input from the state variable updating module 133 to equations (6) and (7) and calculates the sound generation time S[n+1] at which the automatic performance instrument 30 should sound the (n+1)th musical note (Step S35). Specifically, the predicted time calculation module 134 calculates the sound generation time S[n+1] based on the performance position xa[n] and the velocity va[n] which are input from the state variable updating module 133 in Step S35. Then, the predicted time calculation module 134 outputs the sound generation time S[n+1] obtained by the calculation to the output module 14.

When the sound generation time S[n+1] that is input from the prediction module 13 arrives, the output module 14 outputs the performance command corresponding to the (n+1)th musical note that the automatic performance instrument 30 should sound next to the automatic performance instrument 30 (Step S4). In practice, when delays in the process in the output module 14 and the automatic performance instrument 30 are taken into account, it is necessary to output the performance command at a time that is earlier than the sound generation time S[n+1] that is predicted by the prediction module 13, but an explanation thereof is omitted here. The automatic performance instrument 30 generates a sound in accordance with the performance command that is supplied from the timing control device 10 (Step S5).

The prediction module 13 determines whether the performance has ended at a designated timing. Specifically, the prediction module 13 determines the end of the performance based on, for example, the performance position that is estimated by the estimation module 12. When the performance position reaches a designated end point, the prediction module 13 determines that the performance has ended. If the prediction module 13 determines that the performance has ended, the timing control device 10 ends the process shown in the sequence chart of FIG. 4. On the other hand, if the prediction module 13 determines that the performance has not ended, the timing control device 10 and the automatic performance instrument 30 repeatedly execute the process of Steps S1 to S5.

Figure 7:
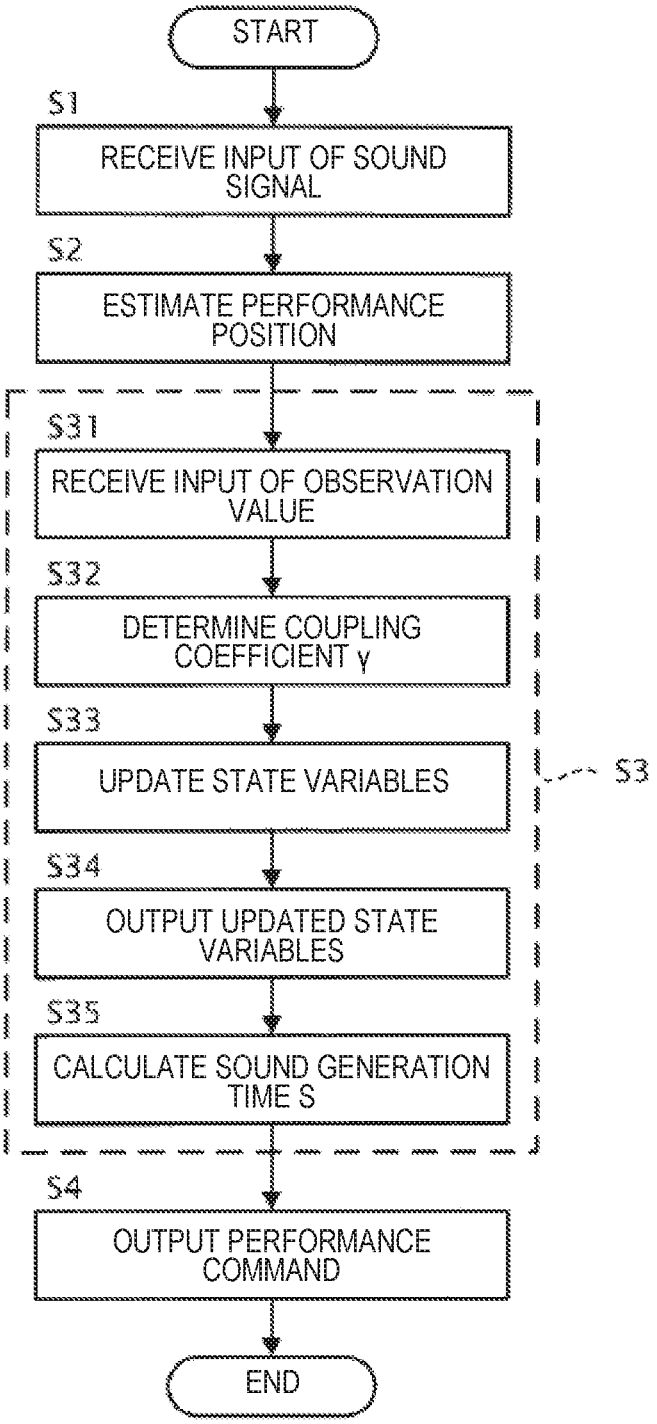
FIG. 7 is a flowchart illustrating the operation of the timing control device.

The operation of the timing control device 10 shown in the sequence chart of FIG. 4 can also be expressed as the flowchart of FIG. 7. That is, in Step S1, the estimation module 12 receives the input of the sound signal. In Step S2, the estimation module 12 estimates the performance position in the musical score. In Step S31, the reception module 131 receives the input of the observation values that are supplied from the estimation module 12. In Step S32, the coefficient changing module 132 determined the coupling coefficient γ[n]. In Step S33, the state variable updating module 133 updates each of the state variables of the state vector V, using the observation values received by the reception module 131 and the coupling coefficient γ[n] determined by the coefficient changing module 132. In Step S34, the state variable updating module 133 outputs the state variables updated in Step S33 to the predicted time calculation module 134. In Step S35, the predicted time calculation module 134 calculates the sound generation time S[n+1] using the updated state variables that are output from the state variable updating module 133. In Step S4, the output module 14 outputs the performance command to the automatic performance instrument 30 based on the sound generation time S[n+1].

3. Modified Examples

The present embodiment is not limited to the embodiment described above, and various modifications are possible. Several modified examples will be described below. Two or more of the following modified examples can be used in combination.

3-1. First Modified Example

The device to be the subject of the timing control by the timing control device 10 (hereinafter referred to as "control target device") is not limited to the automatic performance instrument 30. That is, the "event," the timing of which is predicted by the prediction module 13, is not limited to the sound generation by the automatic performance instrument 30. The control target device can be, for example, a device for generating images that change synchronously with the performance of the performer P (for example, a device that generates computer graphics that change in real time), or a display device (for example, a projector or a direct view display) that changes the image synchronously with the performance of the performer P. In another example, the control target device can be a robot that carries out an operation, such as dance, etc., synchronously with the performance of the performer P.

3-2. Second Modified Example

It is not necessary that the performer P be human. That is, the performance sound of another automatic performance instrument that is different from the automatic performance instrument 30 can be input to the timing control device 10. According to this example, in the ensemble of a plurality of automatic performance instruments, it is possible to cause the performance timing of one of the automatic performance instruments to follow the performance timing of the other automatic performance instruments in real time.

3-3. Third Modified Example

The numbers of performers P and the automatic performance instruments 30 are not limited to those illustrated in the embodiment. The ensemble system 1 can include two or more of the performers P and/or of the automatic performance instruments 30.

3-4. Fourth Modified Example

The functional configuration of the timing control device 10 is not limited to that illustrated in the embodiment. A part of the functional elements illustrated in FIG. 2 can be omitted. For example, it is not necessary for the timing control device 10 to include the predicted time calculation module 134. In this case, the timing control device 10 can simply output the state variables that have been updated by the state variable updating module 133. In this case, the timing of the next event (for example, the sound generation time S[n+1]) can be calculated by a device other than the timing control device 10 into which the state variables that have been updated by the state variable updating module 133 have been input. In addition, in this case, a process other than the calculation of the timing of the next event (for example, displaying an image that visualizes the state variables) can be carried out by the device other than the timing control device 10. In another example, it is not necessary for the timing control device 10 to include the display device 15.

3-5. Fifth Modified Example

In the embodiment and modified examples described above, the coefficient changing module 132 sets the coupling coefficient γ to a value corresponding to the current performance position in the musical score, but the present embodiment is not limited to such a mode. For example, the coefficient changing module 132 can set the value of the coupling coefficient γ to a default value that is set in advance, a value corresponding to an analysis result of the musical score, or to a value corresponding to an instruction from the user.

Figure 6:
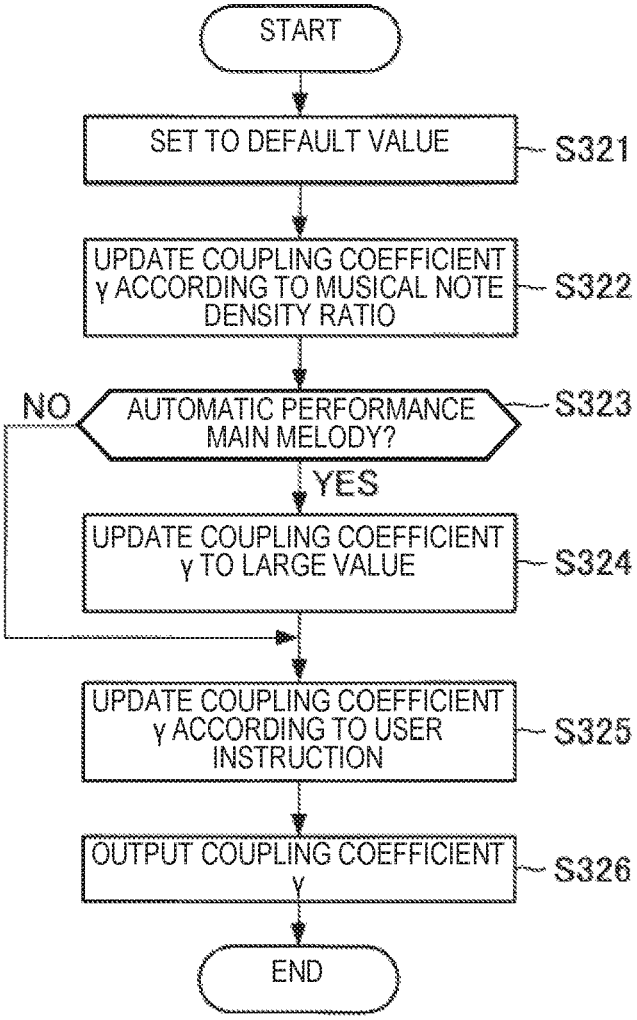
FIG. 6 is a flowchart illustrating a method for determining a coupling coefficient γ according to a fifth modified example.

FIG. 6 is a flowchart illustrating a method for determining the coupling coefficient γ with the coefficient changing module 132 according to the fifth modified example. Each process of the flow chart is a process that is executed within the process of Step S32 shown in FIG. 4.

As shown in FIG. 6, in Step S32, the coefficient changing module 132 sets the value of the coupling coefficient γ[n] to the default value (Step S321).

In the present modified example, the storage device 11 stores the default value of the coupling coefficient γ[n], which is independent of the musical piece (or the performance position in the musical score). In Step S321, the coefficient changing module 132 reads the default value of the coupling coefficient γ[n] stored in the storage device 11 and sets the read default value as the value of the coupling coefficient γ[n]. A default value can be individually set according to each performance position in the musical score.

In Step S32, the coefficient changing module 132 analyzes the musical score and sets the value corresponding to the analysis result as the value of the coupling coefficient γ[n] (Step S322).

Specifically, in Step S322, the coefficient changing module 132 first analyzes the musical score to thereby calculate the ratio of the density of the s that indicate the generation of sound by the performer P to the density of the s that indicate the sound generated by the automatic performance instrument 30 (hereinafter referred to as "density ratio"). Next, the coefficient changing module 132 sets the value corresponding to the calculated musical note density ratio as the value of the coupling coefficient γ[n]. In other words, the coefficient changing module 132 determines the following coefficient (1−γ[n]) based on the musical note density ratio.

For example, when the musical note density ratio is above a designated threshold value, the coefficient changing module 132 sets the value of the coupling coefficient γ[n] such that the value of the coupling coefficient γ[n] becomes smaller compared to a case in which the musical note density ratio is less than or equal to the designated threshold value. In other words, when the musical note density ratio is greater than the designated threshold value, the coefficient changing module 132 sets the value of the coupling coefficient γ[n] such that the value of the following coefficient (1−γ[n]) becomes larger compared to a case in which the musical note density ratio is less than or equal to the designated threshold value. That is, when the musical note density ratio is greater than the designated threshold value, the coefficient changing module 132 sets the value of the coupling coefficient γ[n] so as to increase the ability of the performance by the automatic performance instrument 30 to follow the performance by the performer P, compared to a case in which the musical note density ratio is less than or equal to the designated threshold value.

As an example, as shown in the following equation (12), the coefficient changing module 132 can set the value of the coupling coefficient γ[n] based on the density $DA_n$ of the musical notes that indicate the generation of sound by the automatic performance instrument 30 and the density $DU_n$ of the musical notes that indicate the sound generated by the performer P. In equation (12), $DA_n$ can be the density of the sounds generated by the automatic performance instrument 30 and $DU_n$ can be the density of the sounds generated by the performer P.

Equation $$\gamma[n] = \frac{DA_n}{DA_n + DU_n} \tag{12}$$

In Step S32, the coefficient changing module 132 analyzes the musical score, and determines whether the part being performed by the automatic performance instrument 30 is the main melody (Step S323). A well-known technique is used for determining whether the part being performed by the automatic performance instrument 30 is the main melody.

If it is determined that the part being performed by the automatic performance instrument 30 is the main melody (S323: YES), the coefficient changing module 132 advances the process to Step S324. On the other hand, if it is determined that the part being performed by the automatic performance instrument 30 is not the main melody (S323: NO), the coefficient changing module 132 advances the process to Step S325.

In Step S32, the coefficient changing module 132 updates the value of the coupling coefficient γ[n] to a larger value (Step S324).

For example, in Step S324, the coefficient changing module 132 updates the value of the coupling coefficient γ[n] to a value that is larger than the value indicated on the right side of the equation (12). For example, the coefficient changing module 132 can calculate the updated coupling coefficient γ[n] by means of adding a designated non-negative addition value to the value indicated on the right side of the equation (12). In addition, for example, the coefficient changing module 132 can calculate the updated coupling coefficient γ[n] by means of multiplying the value indicated on the right side of the equation (12) by a designated coefficient greater than 1. The coefficient changing module 132 can also determine the updated coupling coefficient γ[n] to be less than or equal to a prescribed upper limit value.

In Step S32, the coefficient changing module 132 updates the value of the coupling coefficient γ[n] according to an instruction from the user during a rehearsal, or the like (Step S325).

In the present modified example, the storage device 11 stores instruction information that indicates the content of the instructions from the user during a rehearsal, or the like. The instruction information includes, for example, information specifying the part of the performance taking the lead. The information specifying the part of the performance taking the lead is, for example, information that specifies whether the part of the performance taking the lead of the performance is for the performer P or the automatic performance instrument 30. The information specifying the part of the performance taking the lead of the performance can also be set according to the performance position in the musical score. In addition, the instruction information can also be information that indicates the absence of an instruction from the user, when there is no instruction from the user during a rehearsal, or the like.

In Step S325, the coefficient changing module 132 updates the value of the coupling coefficient γ[n] to a smaller value, if the instruction information is information indicating that the performer P is taking the lead. On the other hand, the coefficient changing module 132 updates the value of the coupling coefficient γ[n] to a larger value, if the instruction information is information indicating that the automatic performance instrument 30 is taking the lead. Additionally, the coefficient changing module 132 does not update the value of the coupling coefficient γ[n], if the instruction information is information indicating the absence of an instruction from the user.

In this manner, in the example of FIG. 6, a case is assumed in which the contents of the instruction from the user that can be indicated by the instruction information are three types of contents: content instructing the performer P to take the initiative, content instructing the automatic performance instrument 30 to take the initiative, and content indicating the absence of an instruction from the user; but the instruction information is not limited to such an example. There can be more than three types of contents of the instruction from the user that can be indicated by the instruction information. For example, the contents of the instruction from the user that can be indicated by the instruction information can be information that can indicate a plurality of levels indicating the degree of initiative (for example, high, medium, and low degrees of initiative), in which one level is specified from among the plurality of levels.

In Step S32, the coefficient changing module 132 outputs the value of the coupling coefficient γ[n] determined through the process of Steps S321 to S325 to the state variable updating module 133 (Step S326).

In the example shown in FIG. 6, four judgment factors for determining the coupling coefficient γ[n], "user's instruction (rehearsal result)," "part of the performance related to the main melody," "musical note density ratio," and "default value," are exemplified. Moreover, in the example shown in FIG. 6, a case is exemplified in which the order of priority of the four judgment factors when determining the coupling coefficient γ[n] is "user's instruction">"part of the performance related to the main melody">"musical note density ratio">"default value".

However, the present embodiment is not limited to such a mode. When the coupling coefficient γ[n] is determined, the coefficient changing module 132 can use only a part of the four judgment factors described above. That is, it is sufficient if the process in which the coefficient changing module 132 determines the coupling coefficient γ[n] includes, from among the process of Steps S321 to S326 shown in FIG. 6, the process of Step S326, and at least one or more of the process of Step S321, the process of Step S322, the process of Steps S323 and S324, or the process of Step S325.

In addition, the order of priority of the judgment factors in the determination of the coupling coefficient γ[n] is not limited to the example shown in FIG. 6, and any order of priority can be used. For example, the "part of the performance related to the main melody" can be assigned a higher priority than that of the "user's instruction"; the "musical note density ratio" can be assigned a higher priority than of the "user's instruction"; and the "musical note density ratio" can be assigned a higher priority than of the "part of the performance related to the main melody." In other words, the process of Steps S321 to S326 shown in FIG. 6 can be appropriately rearranged.

3-6. Sixth Modified Example

In the dynamic model relating to the embodiment described above, the state variables are updated using the observation value (the sound generation position u[n] and the observation noise q[n]) at a single point in time, but the present embodiment is not limited to such a mode; the state variables can be updated using the observation values from a plurality of points in time. Specifically, the following equation (13) can be used instead of equation (5) in the observation model of the dynamic model.

Equation $$\begin{pmatrix} u[n-1] \\ u[n-2] \\ \vdots \\ u[n-j] \end{pmatrix} = O_n\begin{pmatrix} x[n] \\ v[n] \end{pmatrix} + \begin{pmatrix} q[n-1] \\ q[n-2] \\ \vdots \\ q[n-j] \end{pmatrix} \tag{13}$$

Here, the matrix On represents the relationship between a plurality of observation values (in this example, the sound generation positions u[n−1], u[n−2], . . . , u[n−j]), and the performance position x[n] and the velocity v[n], in the observation model. By updating the state variables using the plurality of observation values at the plurality of points in time, it is possible to suppress the influence of unexpected noise that occurs in the observation values on the prediction of the sound generation time S[n+1], compared to the case in which the state variables are updated using the observation value from a single point in time.

In the embodiment and the modified examples described above, the prediction module 13 predicts the sound generation time S[n+1] based on the result of updating the state variables using a dynamic model, but the present embodiment is not limited to such a mode; the sound generation time S[n+1] can be predicted using a regression model. In this case, the prediction module 13 can, for example, predict the sound generation time S[n+1] by means of the following equation (14).

Equation $$S[n+1]=\gamma G_n\begin{pmatrix}S[n]\\S[n-1]\\\vdots\\S[n-j]\end{pmatrix}+(1-\gamma)H_n\begin{pmatrix}u[n]\\u[n-1]\\\vdots\\u[n-j]\end{pmatrix}+\alpha_n \tag{14}$$

3-7. Seventh Modified Example

In the embodiment and the modified examples described above, the state variables are updated using the first observation value, but the present embodiment is not limited to such a mode; the state variables can be updated using both the first observation value and the second observation value.

For example, when the performance position xa[n] according to the state transition model is updated, the following equation (15) can be used instead of equation (9). In equation (9), only the sound generation time T, which is the first observation value, is used as the observation value, but in equation (15), the sound generation time T, which is the first observation value, and the sound generation time S, which is the second observation value, are used as the observation values.

Equation $$xa[n]=\gamma[n]\{xa[n-1]+(S[n]-S[n-1])va[n-1]+exa[n]\}+(1-\gamma[n])\{xu[n-1]+(T[n]-T[n-1])vu[n-1]+exu[n]\} \tag{15}$$

In addition, for example, when the performance position xu[n] and the performance position xa[n] according to the state transition model are updated, the following equation (16) can be used instead of equation (8), and the following equation (17) can be used instead of equation (9). Here, the sound generation time Z that appears in the following equations (16) and (17) is a collective term for the sound generation time S and the sound generation time T.

Equation $$xu[n]=xu[n-1]+(Z[n]-Z[n-1])vu[n-1]+exu[n] \tag{16}$$

$$xa[n]=\gamma[n]\{xa[n-1]+(Z[n]-Z[n-1])va[n-1]+exa[n]\}+(1-\gamma[n])\{xu[n-1]+(Z[n]-Z[n-1])vu[n-1]+exu[n]\} \tag{17}$$

In addition, as in the present modified example, when both the first observation value and the second observation value are used in the state transition model, both the first observation value and the second observation value can also be used in the observation model. Specifically, in the observation model, the state variables can be updated by using the following equation (19) in addition to equation (18), which embodies equation (5) according to the embodiment described above.

Equation $$uu[n]=xu[n]+q[n] \tag{18}$$

$$ua[n]=xa[n]+q[n] \tag{19}$$

As in the present modified example, when the state variables are updated using both the first observation value and the second observation value, the state variable updating module 133 can receive the first observation value (the sound generation position uu and the sound generation time T) from the reception module 131 and receive the second observation value (the sound generation position ua and the sound generation time S) from the predicted time calculation module 134.

3-8. Eighth Modified Example

In the embodiment and the modified examples described above, the timing control device 10 controls the sound generation time (timing) of the automatic performance instrument 30, but the present embodiment is not limited to such a mode; the timing control device 10 can control the volume of the sound generated by the automatic performance instrument 30. That is, the mode of the sound generation by the automatic performance instrument 30 that is the subject of control by the timing control device 10 can be the volume of the sound generated by the automatic performance instrument 30. In other words, the timing control device 10 can adjust the degree to which the volume of the sound generated during the performance by the automatic performance instrument 30 follows the volume of the sound generated during the performance by the performer P by means of adjusting the value of the coupling coefficient γ[n].

Furthermore, the timing control device 10 can control both the sound generation time (timing) of the automatic performance instrument 30 and the volume of the sound generated by the automatic performance instrument 30.

3-9. Ninth Modified Example

In the embodiment and modified examples described above, the predicted time calculation module 134 uses equation (6) to calculate the performance position x[t] at a future time t, but the present embodiment is not limited to such a mode. For example, the state variable updating module 133 can calculate the performance position x[n+1] using the dynamic model that updates the state variables.

3-10. Tenth Modified Example

The coefficient changing module 132 according to the embodiment and modified examples described above freely changes the value of the coupling coefficient γ[n] in the middle of the performance of the musical piece by setting the coupling coefficient γ[n] to a value corresponding to the performance position in the musical score, a value corresponding to the result of analyzing the musical score, a value corresponding to an instruction from the user, or the like, but the present embodiment is not limited to such a mode; a prescribed limit can be placed on changes in the coupling coefficient γ[n].

For example, the coefficient changing module 132 can set the value of the coupling coefficient γ[n] subject to a restriction that the absolute value of the amount of change between the coupling coefficient γ[n−1] and the coupling coefficient γ[n] be less than or equal to a designated amount of change. In other words, the coefficient changing module 132 can set the value of the coupling coefficient γ[n] such that the coupling coefficient γ[n] gradually changes as the performance position in the musical score changes. In this case, when there is a change in the tempo of the performance of the performer P, the tempo of the performance of the automatic performance instrument 30 can be made to gradually coincide with the tempo of the performance of the performer P after the change.

In addition, for example, when changing the value of the coupling coefficient γ[n] in the middle of the performance of the musical piece, the coefficient changing module 132 can set the value of the coupling coefficient γ[n] such that the length of time from the starting time of said change to the ending time of said change becomes longer than a prescribed length of time. Even in this case, the coefficient changing module 132 can cause the tempo of the performance of the automatic performance instrument 30 to gradually coincide with the tempo of the performance of the performer P after the change.

3-11. Eleventh Modified Example

The behavior of the performer P that is detected by the sensor group 20 is not limited to the performance sound. The sensor group 20 can detect a movement of the performer P instead of, or in addition to, the performance sound, such as a dance. In this case, the sensor group 20 includes a camera or a motion sensor. In addition, besides the behavior of the performer P, the sensor group 20 can detect the behavior of a subject other than that of a human, such as that of a robot.

3-12. Other Modified Examples

The algorithm for estimating the performance position in the estimation module 12 is not limited to that illustrated in the embodiment. Any algorithm can be applied to the estimation module 12 as long as the algorithm is capable of estimating the performance position in the musical score based on the musical score that is given in advance and the sound signal that is input from the sensor group 20. In addition, the observation value that is input from the estimation module 12 to the prediction module 13 is not limited to that illustrated in the embodiment. Any type of observation value other than the sound generation position u and the sound generation time T can be input to the prediction module 13 as long as the observation value relates to the timing of the performance.

The dynamic model that is used in the prediction module 13 is not limited to that illustrated in the embodiment. In the embodiment and the modified examples described above, the prediction module 13 updates the state vector Va (the second state variable) without using the observation model, but the state vector Va can be updated using both the state transition model and the observation model.

In addition, in the embodiment and the modified examples described above, the prediction module 13 updates the state vector Vu using a Kalman filter, but the state vector V can be updated using an algorithm instead of with the Kalman filter. For example, the prediction module 13 can update the state vector V using a particle filter. In this case, the state transition model that is used in the particle filter can be expressed by equations (2), (4), (8), or (9) described above, or a different state transition model can be used. Additionally, the observation model that is used in the particle filter can be expressed by equations (3), (5), (10), or (11) described above, or a different observation model can be used.

In addition, state variables other than or in addition to the performance position x and the velocity v can also be used. The equations shown in the embodiment are merely examples, and the present embodiment is not limited thereto.

The hardware configuration of each device that constitutes the ensemble system 1 is not limited to that illustrated in the embodiment. Any specific hardware configuration can be used as long as the hardware configuration can realize the required functions. For example, the timing control device 10 can comprise a plurality of processors that respectively correspond to the estimation module 12, the prediction module 13 and the output module 14, rather than functioning as the estimation module 12, the prediction module 13, and the output module 14 by means of a single processor 101 executing a control program. In addition, a plurality of devices can physically cooperate with each other to function as the timing control device 10 in the ensemble system 1.

The control program that is executed by the processor 101 of the timing control device 10 can be provided by means of a non-transitory storage medium, such as an optical disc, a magnetic disk, or a semiconductor memory, or can be provided by means of a download via a communication line such as the Internet. In addition, it is not necessary that the control program include all the steps of FIG. 4. For example, the program can include only Steps S31, S33, and S34.

Preferred Aspects

Preferred aspects that can be ascertained from the descriptions of the embodiment and the modified example above are illustrated below.

First Aspect

A control method according to a first aspect is characterized by comprising: receiving a detection result relating to a first event in a performance; changing a degree to which a second event in the performance follows the first event in the middle of the performance; and determining an operating mode of the second event based on the following degree.

According to this aspect, it is possible to change the ability of the second event in the performance to follow the first event in the performance in the middle of the performance.

Second Aspect

The control method according to a second aspect is a control method according to the first aspect, wherein, when changing the following degree, the length of time from the time at which the change in the following degree is started to the time at which the change in the following degree is ended is longer than a prescribed length of time.

According to this aspect, it is possible gradually change the ability of the second event in the performance to follow the first event in the performance in the middle of the performance.

Third Aspect

The control method according to a third aspect is a control method according to the first or second aspect, wherein, when changing the following degree, the following degree is changed in accordance with a performance position in the musical piece.

According to this aspect, it is possible to change the ability of the second event in the performance to follow the first event in the performance in accordance with the performance position in the musical piece.

Fourth Aspect

The control method according to a fourth aspect is a control method according to the first to the third aspects, wherein, when changing the following degree, the following degree is changed in accordance with a user instruction.

According to this aspect, it is possible to change the ability of the second event in the performance to follow the first event in the performance in accordance with the user instruction.

Fifth Aspect

A control device according to a fifth aspect is characterized by comprising: a reception module that receives a detection result relating to a first event in a performance; a changing module that changes a degree to which a second event in the performance follows the first event in the middle of the performance; and an operation determination module that determines an operating mode of the second event based on the following degree.

According to this aspect, it is possible to change the ability of the second event in the performance to follow the first event in the performance in the middle of the performance.

What is claimed is:

1. A control method comprising:

receiving a detection result relating to a first event in a performance;

changing a following degree in a middle of the performance to which a second event in the performance follows the first event; and determining an operating mode of the second event based on the following degree, wherein in the changing of the following degree, a length of time from a time at which the changing of the following degree is started to a time at which the changing of the following degree is ended is longer than a prescribed length of time.

2. The control method according to claim 1, wherein the following degree is changed in accordance with a position of the performance in a musical piece.

3. The control method according to claim 1, wherein the following degree is changed in accordance with a user instruction.

4. A control device comprising:

an electronic controller including at least one processor, the electronic controller being configured to execute a plurality of modules including a reception module that receives a detection result relating to a first event in a performance, a changing module that changes a following degree in a middle of the performance to which a second event in the performance follows the first event, and an operation determination module that determines an operating mode of the second event based on the following degree, wherein the changing module changes the following degree such that a length of time from a time at which the changing of the following degree is started to a time at which the changing of the following degree is ended is longer than a prescribed length of time.

5. The control device according to claim 4, wherein the changing module changes the following degree in accordance with a position of the performance in a musical piece.

6. The control device according to claim 4, wherein the changing module changes the following degree in accordance with a user instruction.

* * * * *